US009324291B2

(12) United States Patent
Chen et al.

(10) Patent No.: US 9,324,291 B2
(45) Date of Patent: Apr. 26, 2016

(54) LCD DEVICE CONTROL SYSTEM AND LCD DEVICE

(76) Inventors: Yinhung Chen, Shenzhen (CN); Liangchan Liao, Shenzhen (CN); Poshen Lin, Shenzhen (CN)

( * ) Notice: Subject to any disclaimer, the term of this patent is extended or adjusted under 35 U.S.C. 154(b) by 764 days.

(21) Appl. No.: 13/638,576

(22) PCT Filed: Aug. 31, 2012

(86) PCT No.: PCT/CN2012/080864

§ 371 (c)(1), (2), (4) Date: Sep. 28, 2012

(87) PCT Pub. No.: WO2014/026411

PCT Pub. Date: Feb. 20, 2014

(65) Prior Publication Data

US 2014/0042930 A1 Feb. 13, 2014

(30) Foreign Application Priority Data

Aug. 13, 2012 (CN) ..... 2012 1 0286416

(51) Int. Cl.
*H05B 37/02* (2006.01)
*G09G 3/36* (2006.01)
*H05B 33/08* (2006.01)

(52) U.S. Cl.
CPC ..... *G09G 3/3696* (2013.01); *G09G 2330/02* (2013.01); *H05B 33/0815* (2013.01)

(58) Field of Classification Search
USPC ..... 315/294, 292, 315; 345/98, 99, 84, 211, 345/212
See application file for complete search history.

(56) References Cited

U.S. PATENT DOCUMENTS

| | | | | |
|---|---|---|---|---|
| 8,395,612 | B2 * | 3/2013 | Liu et al. | 345/212 |
| 2004/0196279 | A1 * | 10/2004 | Kim et al. | 345/211 |
| 2007/0216672 | A1 * | 9/2007 | Yang et al. | 345/211 |
| 2008/0001894 | A1 | 1/2008 | Oh et al. | |

FOREIGN PATENT DOCUMENTS

| | | | |
|---|---|---|---|
| CN | 2718724 | Y | 8/2005 |
| CN | 1992489 | A | 7/2007 |
| CN | 101042476 | A | 9/2007 |
| CN | 201340717 | Y | 11/2009 |
| CN | 101887699 | A | 11/2010 |
| JP | 2011041465 | A | 2/2011 |

OTHER PUBLICATIONS

Zhang Honglei, the International Searching Authority written comments, May 2013, CN.

* cited by examiner

*Primary Examiner* — Douglas W Owens
*Assistant Examiner* — James H Cho

(57) ABSTRACT

A liquid crystal display (LCD) device control system or an LCD device includes a control circuit board includes a sequence control circuit, a panel includes a source drive circuit, and a scalar circuit board includes a first voltage reduction module. The sequence control circuit is configured with a main power end and an auxiliary power end. The main power end of the sequence control circuit and the source drive circuit are coupled to the first voltage reduction module to supply power.

12 Claims, 2 Drawing Sheets

LCD DEVICE CONTROL SYSTEM AND LCD DEVICE

TECHNICAL HELD

The present disclosure relates to the field of liquid crystal displays (LCDs), and more particularly to an LCD device control system and an LCD device.

BACKGROUND

A liquid crystal display (LCD) device includes a plurality of circuit boards. Voltages of chip components of all the circuit boards are respectively reduced in accordance with voltages required by the chip components. FIG. 1 shows a typical LCD device control system, including a power circuit board, a scalar circuit board, and a control circuit board. Alternating current (AC) is converted by a flyback circuit of the power circuit board, to output 24V to supply power to a voltage converter, and output 12V to supply power to the scalar circuit board and the control circuit board. The scalar circuit board includes two voltage reduction modules, where one of the voltage reduction modules outputs 3.3V to the scalar circuit board. The control circuit board includes corresponding voltage reduction modules, where one of the voltage reduction modules further outputs the 3.3V to a sequence control circuit. The voltage reduction method results in repeated voltage reduction components, thereby causing component waste, and increasing energy consumption.

SUMMARY

In view of the above-described technical problems, the aim of the present disclosure is to provide a liquid crystal display (LCD) device control system and an LCD device capable of reducing cost and energy consumption.

The aim of the present disclosure is achieved by the following technical scheme.

An LCD device control system comprises a control circuit board comprising a sequence control circuit, a panel comprising a source drive circuit, and a scalar circuit board comprising a first voltage reduction module. The sequence control circuit is configured with a main power end and an auxiliary power end. The main power end of the sequence control circuit and the source drive circuit are coupled to the first voltage reduction module to supply power.

In one example, the LCD device control system further comprises a power module that outputs 12V, and a second voltage reduction module coupled to the power module. The first voltage reduction module is supplied power by the second voltage reduction module. This is a two-stage voltage reduction circuit for power supply. Because voltage difference between the input voltage and the output voltage of the voltage reduction module of each stage is small, voltage requirement of the component is lowered, and heat production of the component is correspondingly reduced, thereby being beneficial to selection of low-cost components and simplification of heat dissipation design.

In one example, the LCD device control system comprises a power circuit board and a voltage converter. The power circuit board comprises an power module that outputs 12V, and the power module further outputs 24V to supply power to the voltage converter. The scalar circuit board comprises the first voltage reduction module and the second voltage reduction module, and further comprises a first low-voltage linear voltage regulator and a scalar module (scalar chip) which are supplied power by the first voltage reduction module, a memory module supplied power by the first low-voltage linear voltage regulator, a USB/tuner module supplied power by the second voltage reduction module, and a loudspeaker module coupled to the 12V of the power module. The second voltage reduction module is coupled to the power module, and the second voltage reduction module supplies power to the first voltage reduction module. The control circuit board further comprises a second low-voltage linear voltage regulator supplied power by the first voltage reduction module, a boost circuit coupled to the 12V of the power module, and a charge pump module supplied power by the boost circuit. The output voltage of the second low-voltage linear voltage regulator is coupled to the auxiliary power end of the sequence control circuit. The panel comprises the source drive circuit and a gate drive circuit, and the output voltage of the boost circuit is coupled to the source drive circuit. The charge pump comprises a boost charge pump and a buck charge pump, and output voltages of both of the boost charge pump and the buck charge pump are coupled to the gate drive circuit. The control circuit board is coupled to the scalar circuit board by a low voltage differential signaling (LVDS) cable. This is a first specific LCD device control system.

In one example, the LCD device control system further comprises a power module that outputs 5V. The first voltage reduction module is coupled to the power module. It is found by research that most of the main components of the control system of an LCD panel are supplied by 5V voltage. Therefore, the module that outputs the 5V is used in the technical scheme. Thus components similar to USB/tuner and the like can directly obtain the power from the power module. Therefore, the use of voltage reduction nodules is reduced, and the multi-stage voltage reduction is not required. The advantages of technical scheme are summarized below: the use of the voltage reduction modules is reduced, the multi-stage voltage reduction is not required, and the circuit structure is simplified, thereby being beneficial to development cycle reduction and cost reduction.

In one example, the LCD device control system comprises a power circuit board and a voltage converter. The power circuit board comprises the power module that outputs the 5V, and the power module further outputs the 24V to supply power to the converter. The scalar circuit board comprises the first voltage reduction module coupled to the power module, and further comprises a first low-voltage linear voltage regulator and a scalar module (scalar chip) which are supplied power by the first voltage reduction module, a memory module supplied power by the first low-voltage linear voltage regulator, a USB/tuner module supplied by the 5V of the power module, and a loudspeaker module coupled to the 24V of the power module. The control circuit board comprises the sequence control circuit, a second low-voltage linear voltage regulator supplied power by the first voltage reduction module, a boost circuit coupled to the 5V of the power module, and a charge pump module supplied power by the boost circuit. The output voltage of the second low-voltage linear voltage regulator is coupled to the auxiliary power end of the sequence control circuit. The panel comprises the source drive circuit and a gate drive circuit, and the output voltage of the boost circuit is coupled to the source drive circuit. The charge pump comprises a boost charge pump and a voltage reduction charge pump, and output voltages of both of the boost charge pump and the voltage reduction charge pump are coupled to the gate drive circuit. The control circuit board is coupled to the scalar circuit board by a low-voltage differential signaling (LVDS) cable. This is a second specific LCD device control system. The convener and the loudspeaker both need to be driven by high voltage(s). If the 5V voltage is directly used for boosting voltage, the design difficulty and cost are increased, and high energy consumption is caused. Therefore, the power module independently outputs the 24V in order to simply the subsequent circuit structure, and simplify the subsequent circuit design.

In one example, on the scalar circuit board, the first voltage reduction module is coupled to the first low-voltage linear voltage regulator, and the auxiliary power end of the sequence control circuit is coupled to the first low-voltage linear voltage regulator. One low-voltage linear voltage regulator is required to supply power to the sequence control circuit, and the circuit board on which the first voltage reduction module is located further comprises one low-voltage linear voltage regulator. Therefore, the low-voltage linear voltage regulator of the circuit board on which the first voltage reduction module is located can be used for supplying power to the sequence control circuit, and the cost can be saved.

In one example, the first voltage reduction module is further coupled to the scalar module, the first low-voltage linear voltage regulator is further coupled to the memory module, and the scalar module, the memory module and the sequence control circuit are integrated into one integrated circuit. In the technical scheme, components using the same or similarly voltages are packed and integrated, thereby simplifying the circuit structure, and being beneficial to the reduction of development cost.

In one example, the LCD device control system comprises the power circuit board and the voltage converter. The power circuit board comprises the power module that outputs the 5V, and the power module further outputs the 24V to supply power to the converter. The scalar circuit comprises a first chip and a second chip, the first chip comprises the first voltage reduction module and the first low-voltage linear voltage regulator, and the second chip comprises the scalar module, the memory module and the sequence control circuit. The scalar circuit board further comprises a USB/tuner module supplied by the 5V of the power module, and the loudspeaker module coupled to the 24V of the power module. The control circuit board comprises a boost circuit coupled to the 5V of the power module, and a charge pump module supplied power by the boost circuit. The output voltage of the second low-voltage linear voltage regulator is coupled to the auxiliary power end of the sequence control circuit. The panel comprises the source drive circuit and the gate drive circuit and the output voltage of the boost circuit is coupled to the source drive circuit. The charge pump comprises a boost charge pump and a voltage reduction charge pump, and output voltages of both of the boost charge pump and the voltage reduction charge pump are coupled to the gate drive circuit. The control circuit board is coupled to the scalar circuit board by a flexible flat cable (FFC). This is a third specific LCD device control system.

By using the flexible flat cable (FFC), the number of the connectors of the system can reduce, for example, four connectors are needed when using the low-voltage differential signaling (LVDS) cable, and only two connectors are needed when using the FFC. Moreover, manufacturing mode of the FFC is simple. Therefore, using FFC is beneficial to cost reduction.

In one example, the LCD device control system further comprises a plurality of boost modules and a plurality of voltage reduction modules. Input ends of the boosting modules and the voltage reduction modules are coupled to output ends of the boosting modules and the voltage reduction modules that have a voltage that is closest to the voltage of the input ends of the boosting modules and the voltage reduction modules. By using the voltages with the closest voltage level as the input voltages of the boost modules and the voltage reduction modules, load of the components can be reduced, thereby being beneficial to reduction of module heat productivity and simplification of heat dissipation design. Meanwhile, low-cost components can further be used, thereby being beneficial to the reduction of component cost.

An LCD device comprises the LCD device control system mentioned above.

In the present disclosure, a main power of the sequence control circuit and the source drive circuit are supplied power by the first voltage reduction module of the scalar circuit board. Thus, the voltage reduction module used for supplying power to the main power of the sequence control circuit of the control circuit board and the source drive circuit is omitted, reusability of voltage reduction modules is increased, and a purpose of reducing cost is achieved. In addition, because each voltage reduction module has additional energy consumption, if the use of voltage reduction modules is reduced, energy consumption is correspondingly reduced.

Legends: 100, first chip; 200, second chip.

DETAILED DESCRIPTION

The present disclosure provides a liquid crystal display (LCD) device, and the LCD device comprises an LCD device control system. The LCD device control system comprises a control circuit board comprising a sequence control circuit, a panel comprising a source drive circuit, and a scalar circuit board comprising a first voltage reduction module. The sequence control circuit is configured with a main power end and an auxiliary power end. The main power end of the sequence control circuit and the source drive circuit are coupled to the first voltage reduction module to supply power.

In the present disclosure, the main power of the sequence control circuit and the source drive circuit are supplied power by the first voltage reduction module of the scalar circuit board. Thus, the voltage reduction module supplies power to the main power of the sequence control circuit of the control circuit board and the source drive circuit is omitted, and reusability of voltage reduction modules is increased, and reduced costs is achieved. In addition, because each voltage reduction module consumes additional energy, if the use of voltage reduction modules is reduced, energy consumption is correspondingly reduced.

The present disclosure will further be described in detail in accordance with the figures and the preferable examples.

EXAMPLE 1

Figure 1:
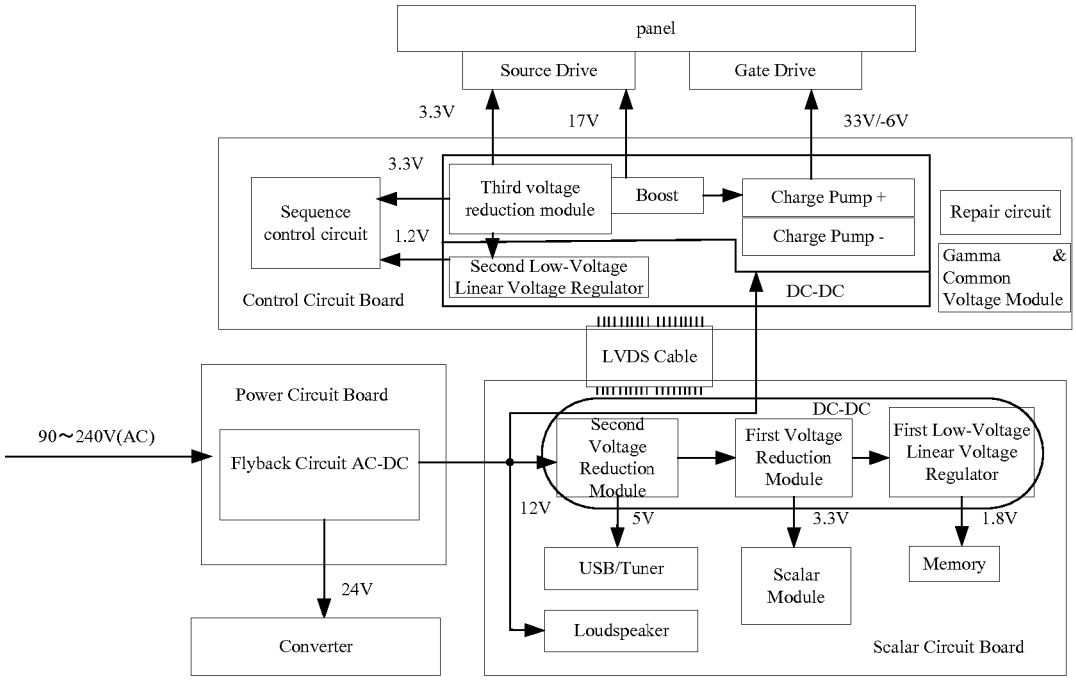
FIG 1 PRIOR ART
FIG. 1 is a schematic diagram of a typical LCD device control system.
Figure 2:
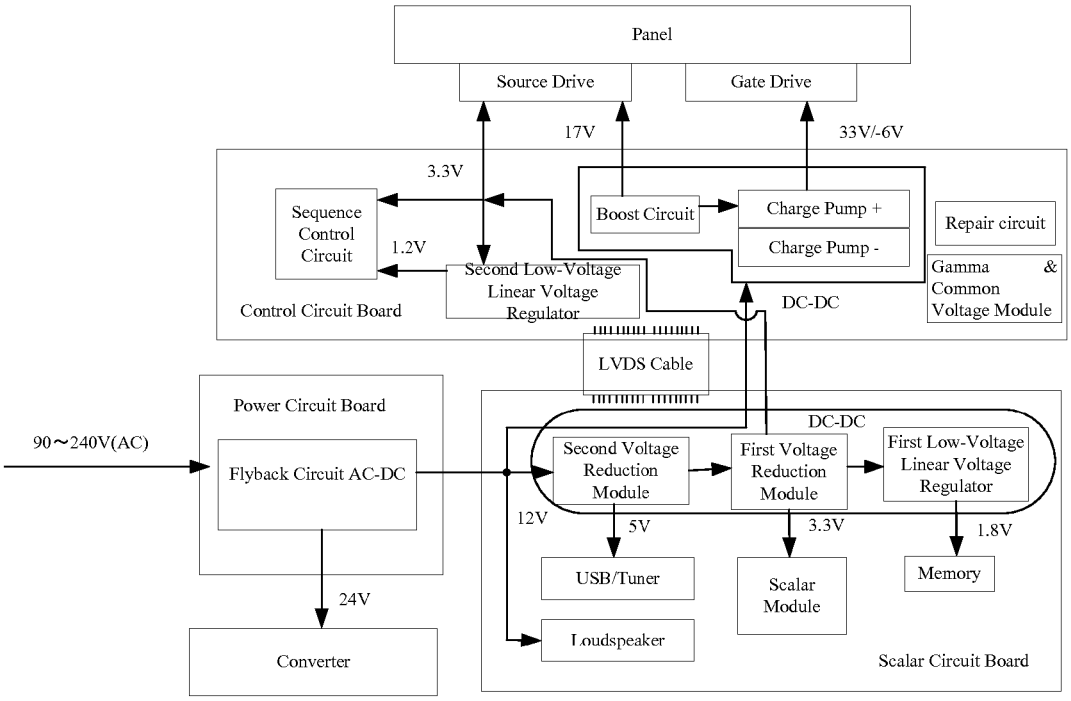
FIG. 2 is a schematic diagram of a first example of the present disclosure.

As shown in FIG. 2, the LCD device control system comprises a power circuit board, a scalar circuit board, a control circuit board, a panel, and a converter. The power circuit board comprises a flyback circuit (i.e., power module), and an input end of the flyback circuit is connected with a 90-240V AC, to output both 12V and 24VAC power. The 24V supplies power to the voltage converter, and the 12V is connected to the scalar circuit board and the control circuit board.

The scalar circuit board comprises a second voltage reduction module, a first voltage reduction module, a first low-voltage linear voltage regulator, and a loudspeaker. The loudspeaker and the second voltage reduction module are coupled to the 12V. The second voltage reduction module outputs 5V, to supply power to a USB/tuner and the first voltage reduction module. The first voltage reduction module outputs 3.3V, to supply power to the scalar module, the sequence control circuit of the control circuit board and the source driver circuit of the panel, and provide a power source for the first low-voltage linear voltage regulator and the second low-voltage linear voltage regulator. The first low-voltage linear voltage regulator supplies power to the memory. The second voltage reduction module, the first voltage reduction module and the first low-voltage linear voltage regulator can be integrated into one chip, and can be separately designed as well.

The control circuit board further comprises a second low-voltage linear voltage regulator supplied power by the first voltage reduction module, the boost circuit coupled to the 12V of the flyback circuit, and a charge pump module supplied power by the boost circuit. Output voltage of the second low-voltage linear voltage regulator is coupled to the auxiliary power end of the sequence control circuit. The control circuit board further comprises a repair circuit module, and a gamma & common voltage module.

The panel further comprises a gate drive circuit, and the boost circuit outputs 17V to the source drive circuit. The charge pump comprises a boost charge pump and a voltage reduction charge pump. Both 33V output by the boost charge pump and 16V output by the voltage reduction charge pump are supplied to the gate drive circuit. The control circuit board is coupled to the scalar circuit board by a low voltage differential signaling (LVDS) cable.

This is a two-stage voltage reduction circuit for power supply. Because a voltage difference between the input voltage and output voltage of the voltage reduction module of each stage is small, voltage requirement to the component is lowered, and heat production of the component is correspondingly reduced, thereby being beneficial to selection of low-cost components and simplification of heat dissipation design.

EXAMPLE 2

Figure 3:
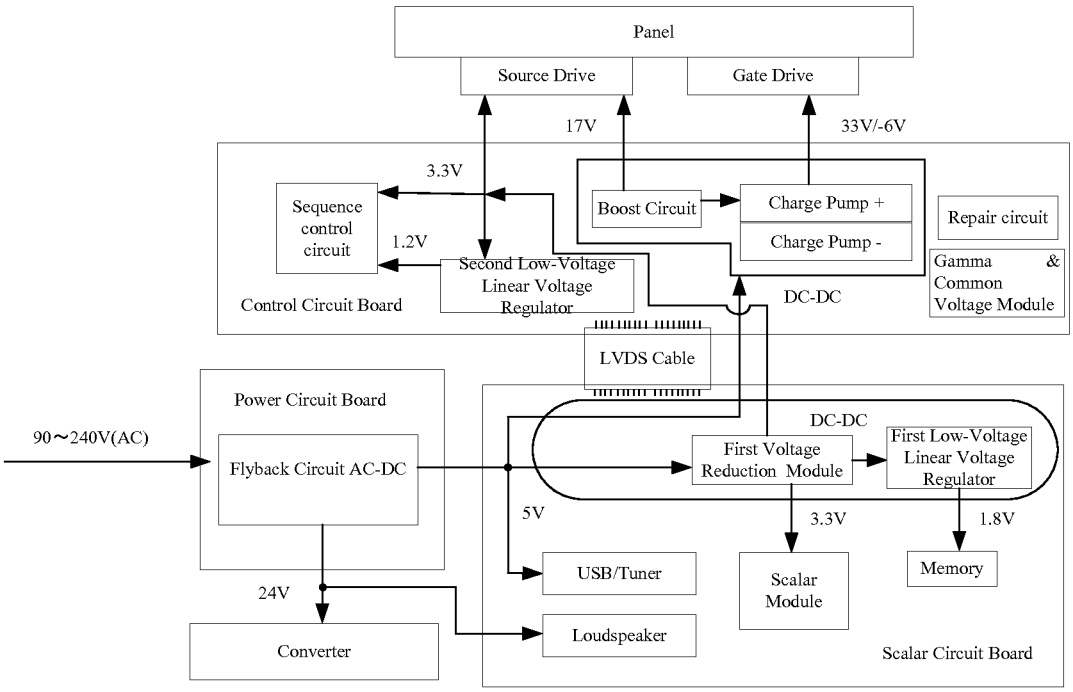
FIG. 3 is a schematic diagram of a second example of the present disclosure.

As shown in FIG. 3, the LCD device control system comprises a power circuit board, a scalar circuit board, a control circuit board, a panel, and a converter. The power circuit board comprises a flyback circuit (i.e., power module), the input end of the flyback circuit is connected with a 90-240V AC power supply, to output DC 5V and 24V. The 24V supplies power to the voltage converter, and the 5V is connected to the scalar circuit board and the control circuit board.

The scalar circuit board comprises a first voltage reduction module, and a first low-voltage linear voltage regulator. The first voltage reduction module is coupled to the 5V. The first voltage reduction module outputs 3.3V, to supply power to the scalar module, The sequence control circuit of the control circuit board and the source driver circuit of the panel, and provide a power source for the first low-voltage linear voltage regulator and the second low-voltage linear voltage regulator. The first low-voltage linear voltage regulator supplies power to the memory of the first low-voltage linear voltage regulator. The first voltage reduction module and the first low-voltage linear voltage regulator can be integrated into one chip, and may be separately designed. The scalar circuit board further comprises a loudspeaker connected with the 24V of the flyback circuit. The voltage converter and the loudspeaker both need to be driven by high voltage(s). If the 5V voltage is directly used for boosting, the design difficulty and cost are increased, and high energy consumption is caused. Therefore, the power module independently outputs the 24V, which can simply the subsequent circuit structure, and simplify the subsequent circuit design.

The control circuit board comprises the sequence control circuit, the second low-voltage linear voltage regulator, the boost circuit coupled to the 5V of the flyback circuit, and the charge pump module supplied power by the boost circuit. The output voltage of the second low-voltage linear voltage regulator is coupled to the auxiliary power end of the sequence control circuit. The control circuit board further comprises a repair circuit module, and a gamma & common voltage module.

The panel further comprises a gate drive circuit, and the boost circuit outputs the 17V to the source drive circuit. The charge pump comprises a boost charge pump and a voltage reduction charge pump. 33V output by the boost charge pump and 16V output by the voltage reduction charge pump both are supplied to the gate drive circuit. The control circuit board is coupled to the scalar circuit board by a low voltage differential signaling (LVDS) cable.

It is found by research that most of the main components of the control system of an LCD panel are supplied by the 5V voltage. Therefore, the power module that outputs the 5V is used in the example. Thus components similar to a USB/tuner and the like can directly obtain power from the power module. Thus, the use of voltage reduction modules is reduced, and the multi-stage voltage reduction is not required. The advantages of the example are summarized below: the use of voltage reduction modules is reduced, the multi-stage voltage reduction is not required, and the circuit structure is simplified, thereby being beneficial to development cycle reduction and cost reduction.

EXAMPLE 3

Figure 4:
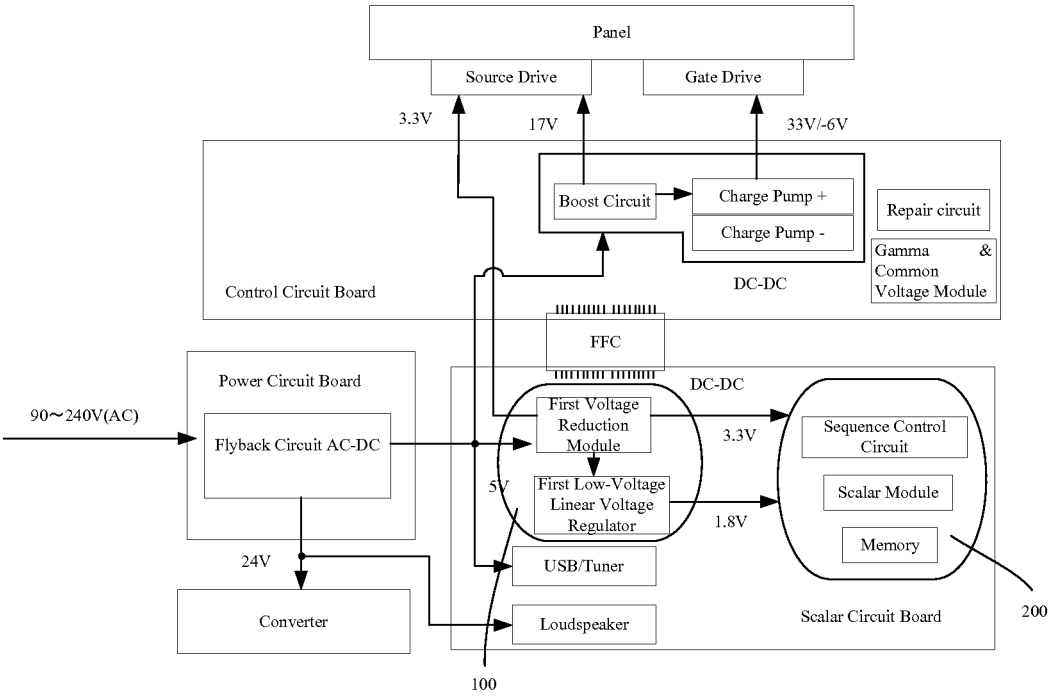
FIG. 4 is a schematic diagram of a third example of the present disclosure.

As shown in FIG. 4, the LCD device control system comprises a power circuit board, a scalar circuit board, a control circuit board, a panel, and a converter. The power circuit board comprises a flyback circuit (i.e., power module), the input end of the flyback circuit is connected with a 90-240V AC power supply, to output DC 5V and 24V. The 24V supplies power to the converter, and the 5V is connected to the scalar circuit board and the control circuit board.

The scalar circuit board comprises a first chip 100, and a second chip 200. The first chip 100 comprises the first voltage reduction module and the first low-voltage linear voltage regulator, and the second chip 200 comprises the scalar module, the memory module and the sequence control circuit. The first voltage reduction module is coupled to the 5V, to output the 3.3V, to supply power to the scalar module, the sequence control circuit of the control circuit board and the source driver circuit of the panel, and provide a power source for the first low-voltage linear voltage regulator and the second low-voltage linear voltage regulator. The first low-voltage linear voltage regulator supplies power to the memory of the first low-voltage linear voltage regulator. The scalar circuit board further comprises a USB/tuner module supplied by the 5V of the flyback circuit, and the loudspeaker module coupled to the 24V of the power module.

The control circuit board comprises the boost circuit coupled to the 5V of the flyback circuit, and the charge pump module supplied power by the boost circuit. Periphery of the control circuit board is connected with a repair circuit module and a gamma & common voltage module.

The panel further comprises a gate drive circuit, and the output voltage of the boost circuit is coupled to the source drive circuit. The charge pump comprises a boost charge pump and a voltage reduction charge pump, and both the output voltages of the boost charge pump and the voltage reduction charge pump are coupled to the gate drive circuit. The control circuit board is coupled to the scalar circuit board by a flexible flat cable (FFC).

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A liquid crystal display (LCD) device control system, comprising:

a control circuit board;

a panel comprising a source drive circuit;

a scalar circuit board comprising a first chip, and a second chip;

a power circuit board comprising a power module that outputs 5V; and a voltage converter; wherein the first chip comprises a first voltage reduction module and a first low-voltage linear voltage regulator, and the second chip comprises a scalar module, a memory module, and a sequence control circuit;

wherein the first voltage reduction module is coupled to the power module; on the scalar circuit board, the first voltage reduction module is coupled to the first low-voltage linear voltage regulator, and an auxiliary power end of the sequence control circuit is coupled to the first low-voltage linear voltage regulator;

wherein the first voltage reduction module is further coupled to the scalar module, the first low-voltage linear voltage regulator is further coupled to the memory module, and the scalar module, the memory module and the sequence control circuit are integrated into one integrated circuit;

wherein the power module further outputs 24V to supply power to the voltage converter; the scalar circuit board further comprises a USB/tuner module supplied by the 5V of the power module, and a loudspeaker module coupled to the 24V of the power module;

wherein the control circuit board comprises the boost circuit coupled to the 5V of the power module, and a charge pump module; the boost circuit supplies power to the charge pump module;

wherein the panel further comprises a gate drive circuit, and output voltage of the boost circuit is coupled to the source drive circuit;

wherein the charge pump module comprises a boost charge pump and a voltage reduction charge pump, and output voltages of both of the boost charge pump and the voltage reduction charge pump are coupled to the gate drive circuit; and wherein the control circuit board is coupled to the scalar circuit board by a flexible flat cable (FFC).

2. A liquid crystal display (LCD) device control system, comprising:

a control circuit board comprising a sequence control circuit;

a panel comprising a source drive circuit; and a scalar circuit board comprising a first voltage reduction module;

wherein the sequence control circuit is configured with a main power end and an auxiliary power end; the main power end of the sequence control circuit and the source drive circuit are supplied power by the first voltage reduction module of the scalar circuit board, wherein the LCD device control system further comprises a plurality of boosting modules and a plurality of voltage reduction modules; input ends of the boosting modules and the voltage reduction modules are coupled to output ends of the boosting modules and the voltage reduction modules that have a voltage that is closest to the voltage of the input ends of the boosting modules and the voltage reduction modules.

3. The LCD device control system of claim 2, wherein the LCD device control system further comprises a power module that outputs 12V, and a second voltage reduction module coupled to the power module and the first voltage reduction module supplied power by the second voltage reduction module.

4. The LCD device control system of claim 2, wherein the LCD device control system further comprises a power circuit board and a voltage converter; the power circuit board comprises a power module that outputs 12V, and the power module further outputs 24V to supply power to the voltage converter;

wherein the scalar circuit board further comprises a second voltage reduction module, and further comprises a first low-voltage linear voltage regulator and a scalar module which are supplied power by the first voltage reduction module, a memory module supplied power by the first low-voltage linear voltage regulator, a USB/tuner module supplied power by the second voltage reduction module, and a loudspeaker module coupled to the 12V of the power module;

wherein the second voltage reduction module is coupled to the power module, and the second voltage reduction module supplies power to the first voltage reduction module;

wherein the control circuit board further comprises a second low-voltage linear voltage regulator supplied power by the first voltage reduction module, a boost circuit coupled to the 12V of the power module, and a charge pump module supplied power by the boost circuit; the output voltage of the second low-voltage linear voltage regulator is coupled to the auxiliary power end of the sequence control circuit; and wherein the panel further comprises a gate drive circuit, and the output voltage of the boost circuit is coupled to the source drive circuit; the charge pump comprises a boost charge pump and a voltage reduction charge pump, and output voltages of both of the boost charge pump and the voltage reduction charge pump are coupled to the gate drive circuit; and the control circuit board is coupled to the scalar circuit board by a low voltage differential signaling (LVDS) cable.

5. The LCD device control system of claim 2, wherein the LCD device control system further comprises a power module that outputs 5V; and the first voltage reduction module is coupled to the power module.

6. The LCD device control system of claim 5, wherein on the scalar circuit board, the first voltage reduction module is coupled to a first low-voltage linear voltage regulator, and the auxiliary power end of the sequence control circuit is coupled to the first low-voltage linear voltage regulator.

7. The LCD device control system of claim 6, wherein the first voltage reduction module is further coupled to the scalar module, the first low-voltage linear voltage regulator is further coupled to a memory module, and the scalar module, the memory module and the sequence control circuit are integrated into one integrated circuit.

8. The LCD device control system of claim 7, wherein the LCD device control system comprises a power circuit board and a voltage converter; the power circuit board comprises the power module that outputs the 5V, and the power module further outputs the 24V to supply power to the voltage converter;

wherein the scalar circuit board comprises a first chip, and a second chip; the first chip comprises the first voltage reduction module and the first low-voltage linear voltage regulator, and the second chip comprises the scalar module, the memory module and the sequence control circuit; the scalar circuit board further comprises a USB/tuner module supplied by the 5V of the power module, and the loudspeaker module coupled to the 24V of the power module;

wherein the control circuit board comprises a boost circuit coupled to the 5V of the power module, and a charge pump module supplied power by the boost circuit; the output voltage of the second low-voltage linear voltage regulator is coupled to the auxiliary power end of the sequence control circuit; and wherein the panel further comprises a gate drive circuit, and the output voltage of the boost circuit is coupled to the source drive circuit, the charge pump comprises a boost charge pump and a voltage reduction charge pump, and both the output voltages of the boost charge pump and the voltage reduction charge pump are coupled to the gate drive circuit; and the control circuit board is coupled to the scalar circuit board by a flexible flat cable (FFC).

9. The LCD device control system of claim 2, wherein the LCD device control system comprises a power circuit board and a voltage converter; the power circuit board comprises a power module that outputs 5V, and the power module further outputs 24V to supply power to the voltage converter;

wherein the scalar circuit board comprises the first voltage reduction module coupled to the power module, and further comprises a first low-voltage linear voltage regulator and a scalar module which are supplied power by the first voltage reduction module, a memory module supplied power by the first low-voltage linear voltage regulator, the USB/tuner module supplied by the 5V of the power module, and the loudspeaker module is coupled to the 24V of the power module;

wherein the control circuit board further comprises a second low-voltage linear voltage regulator supplied power by the first voltage reduction module, a boost circuit coupled to the 5V of the power module, and a charge pump module supplied power by the boost circuit; the output voltage of the second low-voltage linear voltage regulator is coupled to the auxiliary power end of the sequence control circuit; and wherein the panel further comprises a gate drive circuit, and output voltage of the boost circuit is coupled to the source drive circuit; the charge pump module comprises a boost charge pump and a voltage reduction charge pump, and both the output voltages of the boost charge pump and the voltage reduction charge pump are coupled to gate drive circuit; and the control circuit board is coupled to the scalar circuit board by a low voltage differential signaling (LVDS) cable.

10. A liquid crystal display (LCD) device control system, comprising:

a control circuit board comprising a sequence control circuit;

a panel comprising a source drive circuit; and a scalar circuit board comprising a first voltage reduction module;

wherein the sequence control circuit is configured with a main power end and an auxiliary power end; the main power end of the sequence control circuit and the source drive circuit are supplied power by the first voltage reduction module of the scalar circuit board, wherein the LCD device control system further comprises a power module that outputs 5V; and the first voltage reduction module is coupled to the power module, wherein on the scalar circuit board, the first voltage reduction module is coupled to a first low-voltage linear voltage regulator, and the auxiliary power end of the sequence control circuit is coupled to the first low-voltage linear voltage regulator.

11. The LCD device control system of claim 10, wherein the first voltage reduction module is further coupled to a scalar module, the first low-voltage linear voltage regulator is further coupled to a memory module, and the scalar module, the memory module and the sequence control circuit are integrated into one integrated circuit.

12. The LCD device control system of claim 11, wherein the LCD device control system comprises a power circuit board and a voltage converter; the power circuit board comprises the power module that outputs the 5V, and the power module further outputs the 24V to supply power to the voltage converter;

wherein the scalar circuit comprises a first chip, and a second chip; the first chip comprises the first voltage reduction module and the first low-voltage linear voltage regulator, and the second chip comprises the scalar module, the memory module and the sequence control circuit; the scalar circuit board further comprises a USB/tuner module supplied by the 5V of the power module, and the loudspeaker module coupled to the 24V of the power module;

wherein the control circuit board comprises a boost circuit coupled to the 5V of the power module, and a charge pump module supplied power by the boost circuit; the output voltage of the second low-voltage linear voltage regulator is coupled to the auxiliary power end of the sequence control circuit; and wherein the panel further comprises a gate drive circuit, and the output voltage of the boost circuit is coupled to the source drive circuit; the charge pump module comprises a boost charge pump and a voltage reduction charge pump, and both the output voltages of the boost charge pump and the voltage reduction charge pump are coupled to the gate drive circuit; and the control circuit board is coupled to the scalar circuit board by a flexible flat cable (FFC).

* * * * *